US006324972B1

(12) United States Patent
Kempen

(10) Patent No.: US 6,324,972 B1
(45) Date of Patent: Dec. 4, 2001

(54) ROTARY SCREEN-PRINTING DEVICE WITH SUPPORT MEANS FOR A SQUEEGEE

(75) Inventor: Henricus G. M. Kempen, Ledeacker (NL)

(73) Assignee: Stork Brabant B.V., Boxmeer (NL)

( * ) Notice: Subject to any disclaimer, the term of this patent is extended or adjusted under 35 U.S.C. 154(b) by 0 days.

(21) Appl. No.: 09/566,283

(22) Filed: May 5, 2000

(30) Foreign Application Priority Data

May 7, 1999 (NL) ..... 1011994

(51) Int. Cl.[7] ..... B41L 13/00
(52) U.S. Cl. ..... 101/120; 101/116
(58) Field of Search ..... 101/114, 116, 101/117, 118, 119, 120, 129

(56) References Cited

U.S. PATENT DOCUMENTS 4,077,320 * 3/1978 Weber et al. ..... 101/119
5,213,033 * 5/1993 Bourgeois et al. ..... 101/116
5,992,313 * 11/1999 Zimmer ..... 101/120

FOREIGN PATENT DOCUMENTS 0 485 912 A1 5/1992 (EP) .
0 855 957 B1 8/1998 (EP) .
0 863 000 A1 9/1998 (EP) .

* cited by examiner

*Primary Examiner*—Ren Yan
(74) *Attorney, Agent, or Firm*—Hoffmann & Baron, LLP

(57) ABSTRACT

Rotary screen-printing device for printing a substrate, includes at least one printing station for a removable stencil, a printing-medium feed and a squeegee, substrate-conveying means for guiding a substrate past the printing station, first and second stencil-bearing means for supporting opposite ends of the stencil, and first and second support means for supporting opposite ends parts of the squeegee. The second support means includes a moveable support member which can move between a position in which it supports the squeegee and a position in which it does not support the squeegee. The first support means being designed in such a manner that it is able to hold the squeegee in a floating position if the support member of the second support means is in the non-supporting position. The first support means includes a support member and a delimiting member. The support member of the first support means forms a free resting point for supporting the squeegee, and the delimiting member forms a free stop point for delimiting the squeegee upwardly. The delimiting member is intended to act on the squeegee further towards the outside than the support member of the first support means.

8 Claims, 4 Drawing Sheets

ROTARY SCREEN-PRINTING DEVICE WITH SUPPORT MEANS FOR A SQUEEGEE

FIELD OF THE INVENTION

The invention relates to a rotary screen-printing device for printing a substrate, comprising:

- at least one printing station for a removable stencil, a printing-medium feed and a squeegee;
- substrate-conveying means for guiding a substrate past said printing station;
- first and second stencil-bearing means for supporting opposite ends of a stencil; and
- first and second support means for supporting opposite ends parts of a squeegee; said second support means comprising a moveable support member which can move between a position in which it supports a squeegee and a position in which it does not support a squeegee, and said first support means being designed in such a manner that they are able to hold a squeegee in a floating position if said support member of said second support means is in the non-supporting position.

BACKGROUND OF THE INVENTION

A device of this nature is known from EP-A-0,863,000. The rotary screen-printing device comprises a printing station which is arranged on an angle and has a removable stencil and a squeegee extending through the latter. During a printing process, the squeegee is supported at two end parts. The first end part is fixedly connected to a pivot point, and the second end part is supported on a moveable support member. The first end part is also fixedly connected to an actuable lifting cylinder. While a stencil is being changed, the moveable support member can be disengaged from the second end part of the squeegee. The squeegee is then held in place by the fixed connection of the first end part to the pivot point and the lifting cylinder. Then, the lifting cylinder can be actuated in such a manner that the squeegee rotates about its pivot point and moves into a position where it is at an angle with respect to the substrate-conveying means. The stencil also tilts upwards and can easily be pushed off the squeegee, which is clamped securely in place on one side.

A drawback of this known device is that the squeegee is fixedly connected to the device. The squeegee cannot easily be removed from the device. Consequently, the length and type of the squeegee are substantially fixed, which may be a drawback since, in practice, printing is carried out using various printing widths and/or types of squeegee. During a cleaning operation, the squeegee must, out of necessity, be washed on the device itself. A further drawback is that the squeegee cannot be tilted about its longitudinal axis. The fixed connection to the pivot point and the lifting cylinder makes this impossible. For example, in the case of a squeegee having a support strip and a roller squeegee, it is consequently impossible to adjust the gap width between the support strip and the roller squeegee. Since, in practice, roller squeegees of different diameters are frequently used for printing, this means that the gap width will vary accordingly.

SUMMARY OF THE INVENTION

The object of the present invention is to overcome the above drawbacks and, in particular, to provide a rotary screen-printing device, squeegees of which can easily be removed from the device and, if desired, cleaned or replaced by squeegees of a different type and/or of a different length.

This object is achieved according to the invention by means of a rotary screen-printing device according to claim 1. The device comprises first and second support means for supporting opposite first and second end parts of a squeegee. The first support means comprise a support member and a delimiting member, which are both intended to act on the first end part of the squeegee. The support member is a free resting point for supporting the squeegee, and the delimiting member is a free stop point for delimiting the squeegee upwardly. The delimiting member lies further towards the outside, with respect to the centre of gravity of the squeegee, than the support member. The squeegee can be fitted freely with one of its end parts between the first support means and thus can remain suspended, clamped in on one side. The remainder of the squeegee is then hanging freely, so that it is possible to push a stencil over the squeegee in the axial direction. After an end part of the squeege has been clamped into the first support means, a support member of the second support means can be brought into engagement with an opposite end part, after which the squeegee is then supported at two ends. During a printing process, the delimiting member may optionally remain in contact with the squeegee. Subsequently, the squeegee can be clamped in again on one side in the first support means, after which the support member of the second support means can be moved into a position in which the squeegee is no longer supported and where the second support means are not standing in the way of the stencil being removed. Highly advantageously, it is possible for the squeegee to be removed from the first support means at any desired moment, for example for a cleaning operation, for replacement by another type of squeegee or for replacement by a squeegee of a different length. The free enclosure between the support member and the delimiting member can provide support and guidance during fitting or removal of the squeegee. This is particularly advantageous for long and heavy squeegees, and even enables such squeegees to be removed or fitted by one person without there being any risk of damage to the squeegees. Consequently, the device is highly flexible and is easy to adapt to the requirements of individual users. The free enclosure of the squeegee in the first support means advantageously enables the squeegee to tilt about its longitudinal axis, for example if roller squeegees of different diameters are used. In particular, the first and/or second support means are, for this purpose, provided with a clamping mechanism, in order for it to be possible for the squeegee to be clamped securely in a desired tilted position. The clamping mechanism may, for example, be formed by a clamping screw which acts on an end part of the squeegee.

Preferred embodiments of the invention are defined in the subclaims.

BRIEF DESCRIPTION OF THE DRAWINGS

The invention will be explained in more detail with reference to the appended drawing, in which.

DESCRIPTION OF THE PREFERRED EMBODIMENTS

Figure 1:
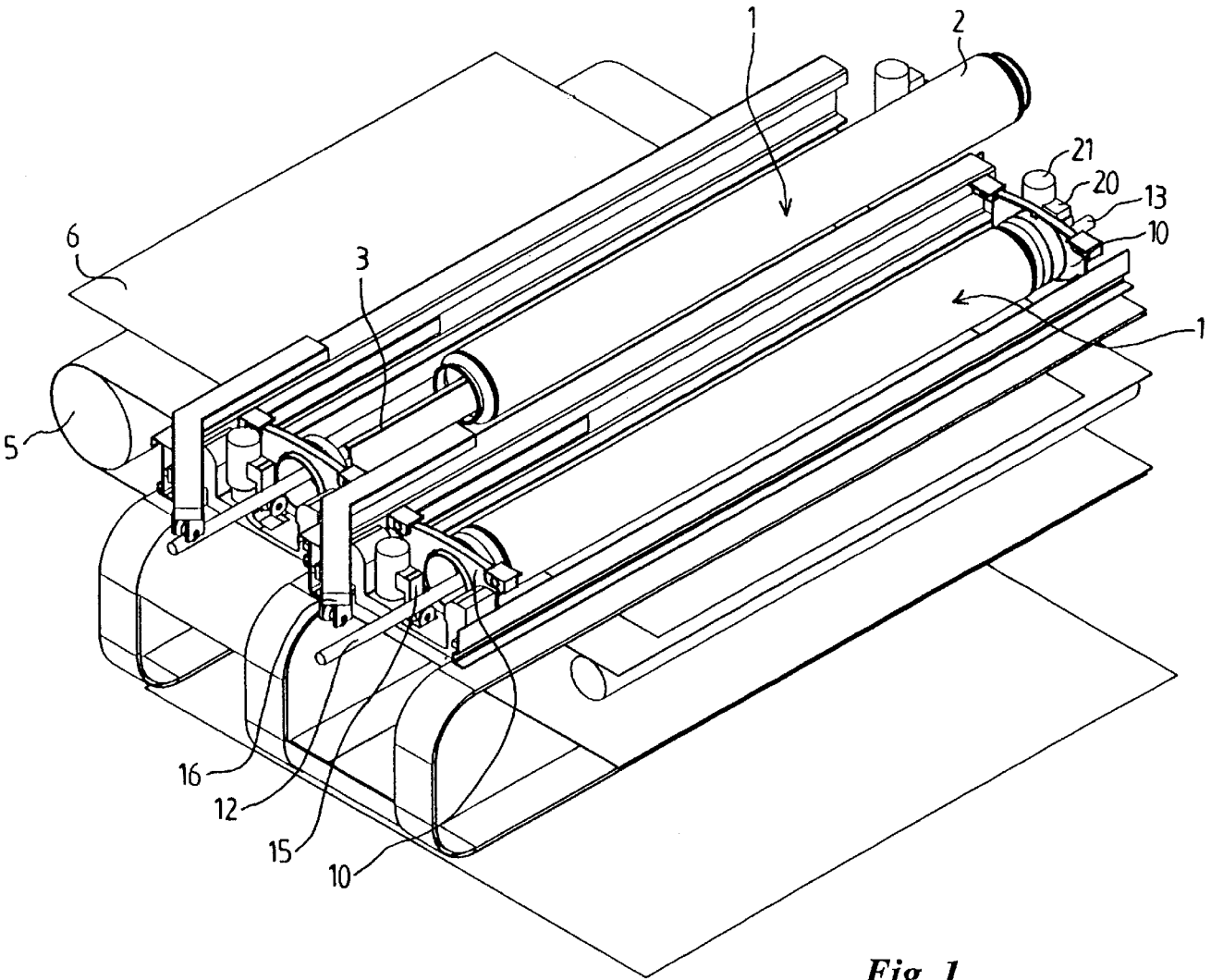
FIG. 1 shows a perspective view of part of a rotary screen-printing device according to the invention.
Figure 2:
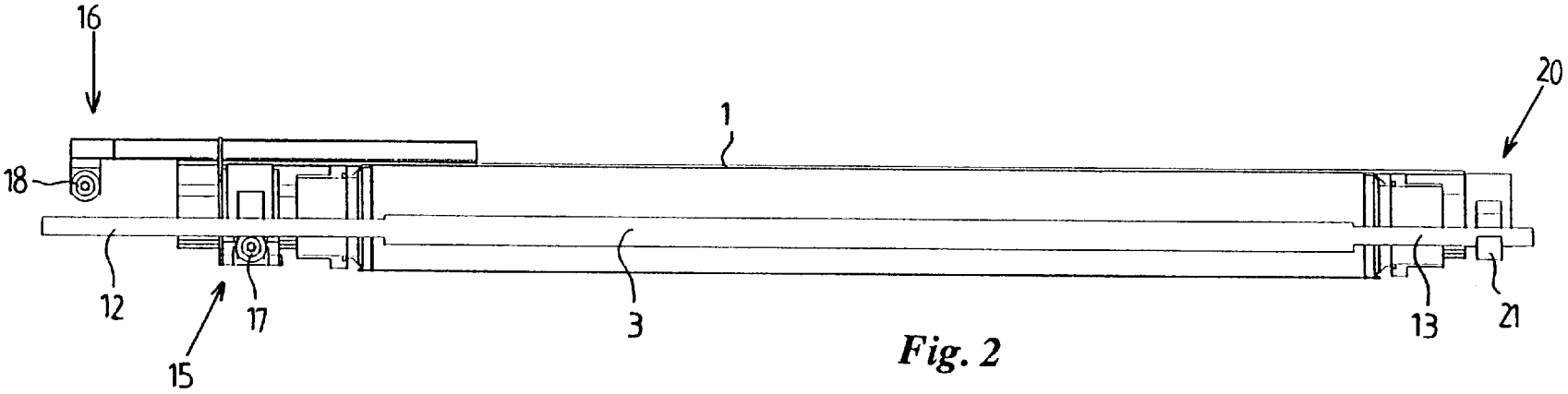
FIG. 2 shows a longitudinal sectional view through a printing station from FIG. 1, with a squeegee in a printing position.

The rotary screen-printing device shown in FIG. 1 comprises two printing stations 1, each with a removable stencil 2 and a removable squeegee 3. During a printing process, with the aid of substrate-conveying means 5, in this case formed by a printing belt which is guided over rollers, a substrate 6 is guided past the printing stations 1 and is printed with a specific design in a designated colour. For the stencil 2, first and second stencil-bearing means 10 are provided, in which the stencil 2 is rotably supported by means of its ends. The stencil-bearing means 10 can be moved up and down between a printing position and a raised position. The squeegee 3 comprises rod-like end parts 12, 13 which are supported by first and second support means which are connected to the frame of the device. The first support means comprise a support member 15 and a delimiting member 16. The support member 15 comprises a running wheel 17 with a circumferential groove. The rod-like end part 12 is supported on the top side of the running wheel 17 in such a manner that it can roll to and fro. The delimiting member 16 likewise comprises a running wheel 18 with a circumferential groove. The abovementioned rod-like end part 12 bears against the underside of this running wheel 18 in such a manner that it can roll to and fro. The second support means comprise a moveable support member 20 which can rotate about a column 21, between an active position, in which the squeegee 3 is also supported by its other end part 13 (cf. FIG. 2 and the right-hand printing station 1 in FIG. 1), and an inactive position, in which the squeegee 3 is not supported at its other end part 13 (cf. FIG. 3 and the left-hand printing station in FIG. 1). In the embodiment shown, the support member 20 comprises a hook-shaped shaped element 21, but may also be of any other desired form. The delimiting member 16 is positioned further towards the outside of the device than the support member 15. Consequently, in the clamped-in position, the centre of gravity of the squeegee 3 as a whole lies on the side of the support member 15.

If both the support member 15 and the delimiting member 16 bear against the rod-like end part 12, the second support means can be moved into the inactive position. This can be seen clearly in FIG. 3. The squeegee 3 then remains clamped in on one side, by means of its rod-like end part 12, by the first support means, while its remaining part is held in place hanging freely. In this floating position, the stencil-bearing means 10 lying in the vicinity of the second support means can be removed, and the stencil 2 can be pushed in the axial direction of the squeegee 3. During these actions carried out on the stencil, the squeegee 3 remains in place and, if desired, may even, in a subsequent stage, itself be pulled axially out of its first support means.

Figure 3:
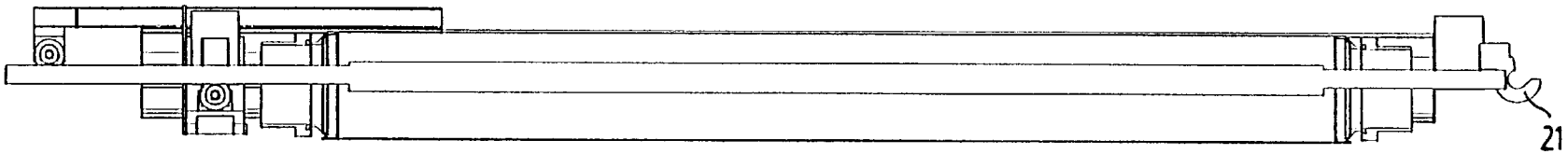
FIG. 3 shows a similar view to that of FIG. 2, with a squeegee in a free position.

The support members 15 and 20 of the first and second support means, respectively, are arranged in a vertically adjustable manner and, for this purpose, are connected, for example, to lifting cylinders. By suitable actuation of the lifting cylinders, the squeegee 3 can be moved between a printing position (FIG. 2) and a free position (FIG. 3). The delimiting member 16 is arranged in a fixed position and automatically comes to bear against the rod-like end part 12 if the squeegee 3 is moved into its free position. In the free position, the entire squeegee 3 lies freely in the stencil 2, so that the stencil 2 can be pushed off without there being any risk of damage to the squeegee 3.

In a variant, the delimiting member is also arranged vertically adjustably, and can be moved up and down between the printing position and the free position together with the support members. It is also possible to provide separate movement means for the delimiting member, by means of which the clamp-in rod-like end part can be pressed downwards slightly with respect to the support member of the first support means, in order for the squeegee to be tilted up slightly, optionally together with the stencil, so as to facilitate operations.

As an alternative to running wheels, it is also possible to use other guide elements, such as friction-reducing slide elements.

Figure 4:
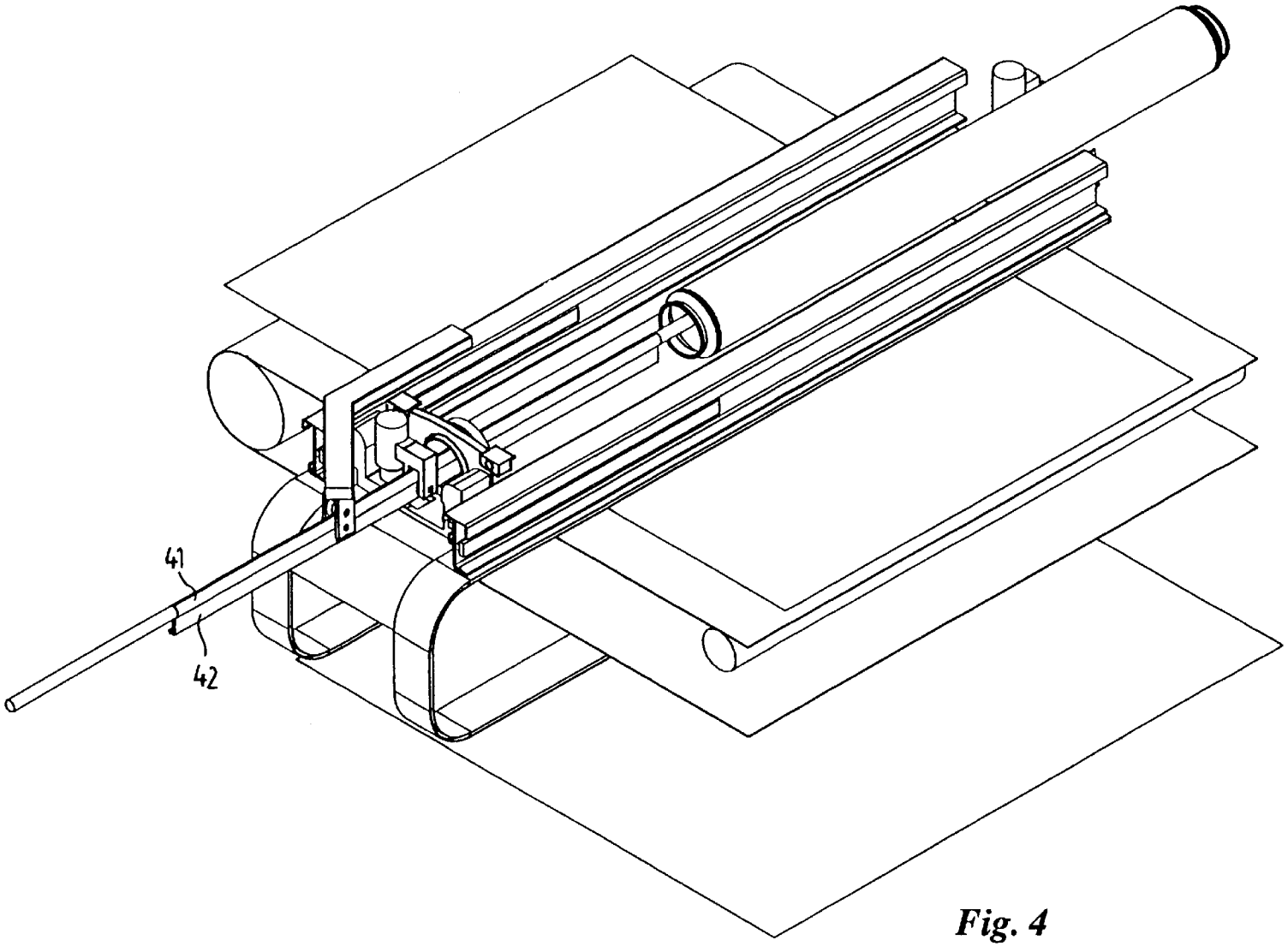
FIG. 4 shows a view, corresponding to that shown in FIG. 1, of a variant embodiment.
Figure 5:
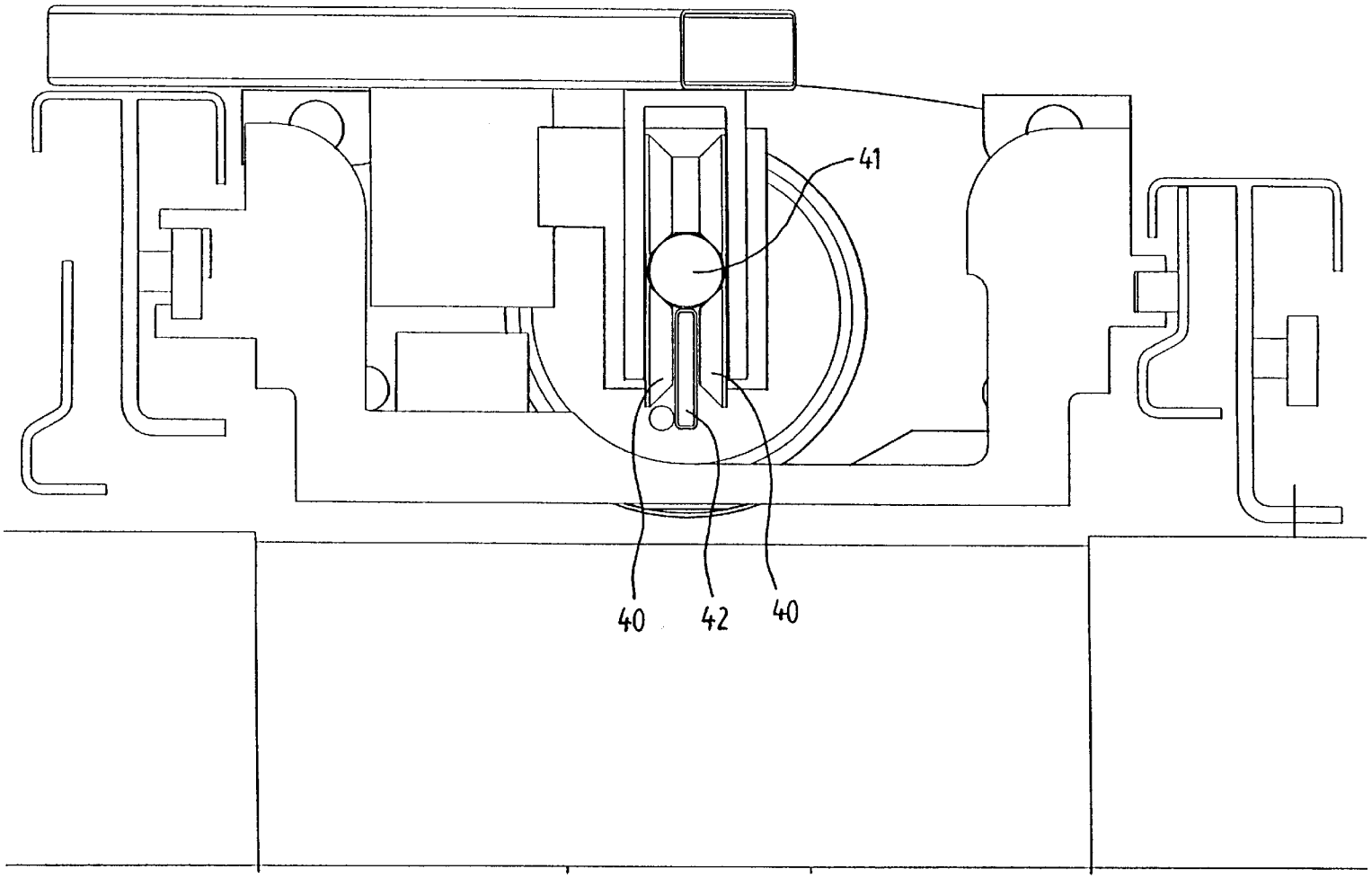
FIG. 5 shows a side view of the printing station shown in FIG. 4.

FIGS. 4 and 5 illustrate a variant in which the support member comprises two running wheels 40 which are located with a small space between them. The squeegee comprises a tubular part 41 and a slender rectangular profile part 42 which is fixedly connected to the underside of the tubular part 41. The size of the space between the two running wheels 40 is such that the profiled part 42 can move freely to and fro between the said wheels. The tubular part 41 is too large to do this and is supported on the running wheels 40. In this embodiment, it is advantageously possible to move the entire squeegee to and fro in both directions along the first support means. As a result, the squeegee can also be removed or fitted on the side of the first support means, in which case the first support means form a support and guide for an operator during the entire operation carried out on the squeegee. The support and guide make it possible that only one person is required for the operations carried out on the squeegee. In this case, the stencil can remain in place and will not be damaged. It is even possible for operations on the stencil and the squeegee to be carried out simultaneously, in which case the squeegee operations take place towards a different side than the stencil operations.

Advantageously, the first and/or the second support means are arranged in such a manner that they can slide in the axial direction. The device can then easily be adapted to different lengths of squeegees.

The stencil-bearing means may comprise one or two stencil heads which can be displaced in the axial direction, in which case in particular the first and/or second support means are connected to the displaceable stencil heads. It is then possible, by means of a single adjustment operation, to render the device suitable for a different length of stencil and squeegee, for example if a narrower printing width is desired.

Thus, the invention provides a rotary screen-printing device in which stencils can be changed at a printing station while a squeegee remains clamped in on one side. As an alternative to one delimiting member and one support member, the first support means may also comprise a plurality of delimiting and/or support members, which are all intended to act on a first end part of a squeegee in such a manner that the squeegee can be moved to and fro between the members in the axial direction. The device is suitable for various types of squeegees, such as roller squeegees, blade squeegees and chamber-type squeegees, and can thus be employed as a multifunctional device.

What is claimed is:

1. Rotary screen-printing device for printing a substrate, comprising:

at least one printing station including a removable cylindrical stencil having an interior space, means for feeding a printing medium to the interior space of the cylindrical stencil, and an elongated squeegee extending parallel to and disposed in the interior space of the cylindrical stencil;

substrate-conveying means for guiding a substrate past said printing station;

first and second stencil-bearing means for supporting opposite ends of said stencil; and first and second support means for supporting opposite ends parts of said squeegee; said second support means comprising a moveable support member which can move between a position in which it supports said squeegee and a position in which it does not support said squeegee, and said first support means being designed in such a manner that they are able to hold said squeegee in a floating position if said support member of said second support means is in the non-supporting position, wherein said first support means comprise a support member and a delimiting member, said support member of said first support means forming a free resting point for supporting said squeegee, and said delimiting member forming a free stop point for delimiting said squeegee upwardly, and said delimiting member being placed further towards the side of the device than said support member of said first support means.

2. Rotary screen-printing device according to claim 1, in which said support member and said delimiting member of said first support means comprise guide elements, between which said squeegee can be displaced freely in an axial direction of said squeegee.

3. Rotary screen-printing device according to claim 2, in which said guide elements comprise running wheels.

4. Rotary screen-printing device according to claim 1, in which said support member and/or said delimiting member of said first support means are arranged displaceably.

5. Rotary screen-printing device according to claim 4, in which said support member and/or said delimiting member of said first support means are arranged displaceably in a radial direction of said removable stencil to be placed.

6. Rotary screen-printing device according to claim 4, in which said support member and/or said delimiting member of said first support means are arranged displaceably in an axial direction of said removable stencil to be placed.

7. Rotary screen-printing device according to claim 1, in which said stencil-bearing means comprise at least one stencil head which can be displaced in an axial direction of said removable stencil to be placed, and in which said first or said second support means are connected to said displaceable stencil head.

8. Rotary screen-printing device according to claim 1, in which said support members of said first and second support means and said stencil-bearing means can move together between a printing position and a raised position, and in which said squeegee, in the raised position, comes to bear freely against said delimiting member of said first support means.

* * * * *